US010822971B2

(12) United States Patent
Spangler et al.

(10) Patent No.: US 10,822,971 B2
(45) Date of Patent: Nov. 3, 2020

(54) COOLING HOLE FOR A GAS TURBINE ENGINE COMPONENT

(71) Applicant: UNITED TECHNOLOGIES CORPORATION, Farmington, CT (US)

(72) Inventors: Brandon W. Spangler, Vernon, CT (US); Dominic J. Mongillo, West Hartford, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 0 days.

(21) Appl. No.: 16/283,279

(22) Filed: Feb. 22, 2019

(65) Prior Publication Data

US 2019/0186277 A1 Jun. 20, 2019

Related U.S. Application Data

(63) Continuation of application No. 14/766,496, filed as application No. PCT/US2014/015195 on Feb. 7, 2014, now Pat. No. 10,309,239.

(Continued)

(51) Int. Cl.

*F01D 9/02* (2006.01)
*F01D 5/18* (2006.01)

(Continued)

(52) U.S. Cl.

CPC ..... *F01D 9/023* (2013.01); *F01D 5/186* (2013.01); *F01D 9/065* (2013.01); *F01D 11/20* (2013.01);

(Continued)

(58) Field of Classification Search

CPC ..... F01D 9/023; F01D 9/065; F01D 5/186; F01D 5/183; F01D 5/184; F01D 5/18;

(Continued)

(56) References Cited

U.S. PATENT DOCUMENTS 4,684,323 A 8/1987 Field
4,726,735 A * 2/1988 Field ..... F01D 5/186 415/115

(Continued)

OTHER PUBLICATIONS

International Search Report and Written Opinion of the International Searching Authority for International Application No. PCT/US2014/015195 dated May 14, 2014.

(Continued)

*Primary Examiner* — Mark A Laurenzi
*Assistant Examiner* — Mickey H France
(74) *Attorney, Agent, or Firm* — Carlson, Gaskey & Olds, P.C.

(57) ABSTRACT

A component for a gas turbine engine according to an exemplary aspect of the present disclosure includes, among other things, a wall having an internal surface and an outer skin, a cooling hole having an inlet extending from the internal surface and merging into a metering section, and a diffusion section downstream of the metering section that extends to an outlet located at the outer skin. The diffusion section of the cooling hole includes a first side diffusion angle, a second side diffusion angle and a downstream diffusion angle at a downstream surface of the diffusion section, the downstream diffusion angle being less than the first side diffusion angle and the second side diffusion angle.

18 Claims, 5 Drawing Sheets

Related U.S. Application Data

(60) Provisional application No. 61/765,211, filed on Feb. 15, 2013.

(51) Int. Cl.

| | |
|---|---|
| ***F01D 9/06*** | (2006.01) |
| ***F23R 3/00*** | (2006.01) |
| ***F01D 11/20*** | (2006.01) |
| *F01D 5/28* | (2006.01) |

(52) U.S. Cl.

CPC ..... *F23R 3/002* (2013.01); *F01D 5/288* (2013.01); *F05D 2240/11* (2013.01); *F05D 2240/81* (2013.01); *F05D 2250/12* (2013.01); *F05D 2260/202* (2013.01); *F23R 2900/03042* (2013.01)

(58) Field of Classification Search

CPC . F01D 5/288; F01D 5/08; F01D 5/081; F01D 5/084; F01D 5/085; F01D 25/12; F01D 11/20; F05D 2260/202; F05D 2240/81; F05D 2250/12; F05D 2250/14; F05D 2250/141; F05D 2240/11; F23R 3/002; F23R 2900/03042; F05B 2260/202; F02C 7/12; F02C 7/125

USPC ..... 415/177; 29/889.7, 889.721; 416/95

See application file for complete search history.

(56) References Cited

U.S. PATENT DOCUMENTS

| | | | | |
|---|---|---|---|---|
| 7,374,401 | B2 | 5/2008 | Lee | |
| 7,997,868 | B1 | 8/2011 | Liang | |
| 8,057,179 | B1 | 11/2011 | Liang | |
| 8,057,180 | B1 | 11/2011 | Liang | |
| 8,066,484 | B1 | 11/2011 | Liang | |
| 8,092,177 | B2 | 1/2012 | Liang | |
| 8,168,912 | B1 | 5/2012 | Liang | |
| 8,814,500 | B1 * | 8/2014 | Liang ..... | F01D 5/186 415/115 |
| 2004/0094524 | A1 | 5/2004 | Stevens | |
| 2006/0073015 | A1 | 4/2006 | Liang | |
| 2008/0031738 | A1 | 2/2008 | Lee | |
| 2008/0124214 | A1 | 5/2008 | Lutjen et al. | |
| 2012/0102959 | A1 | 5/2012 | Starkweather | |
| 2013/0017064 | A1 | 1/2013 | Naik et al. | |

OTHER PUBLICATIONS

International Preliminary Report on Patentability for International Application No. PCT/US2014/015195 dated Aug. 27, 2015.

Extended European Search Report for Application No. EP 14 75 2111 dated Sep. 12, 2016.

* cited by examiner

COOLING HOLE FOR A GAS TURBINE ENGINE COMPONENT

CROSS-REFERENCED TO RELATED APPLICATION

This application is a continuation of application Ser. No. 14/766,496, which was filed on Aug. 7, 2015, which claims priority to PCT/US14/15195, filed on Feb. 7, 2014, which claims priority to U.S. Provisional Application No. 61/765,211, filed on Feb. 15, 2013.

BACKGROUND

This disclosure relates to a gas turbine engine, and more particularly to a gas turbine engine component having a cooling hole that reduces or excludes a downstream diffusion angle.

Gas turbine engines typically include a compressor section, a combustor section and a turbine section. During operation, air is pressurized in the compressor section and is mixed with fuel and burned in the combustor section to generate hot combustion gases. The hot combustion gases are communicated through the turbine section, which extracts energy from the hot combustion gases to power the compressor section and other gas turbine engine loads.

The combustion gases generated during operation of the gas turbine engine are typically extremely hot, and therefore the components that extend into the core flow path of the gas turbine engine may be subjected to extremely high temperatures. Thus, air cooling arrangements may be provided for many of these components.

For example, airfoil and platform portions of blades and vanes may extend into the core flow path of a gas turbine engine. These portions may include cooling holes that are part of a cooling arrangement of the component. Cooling air is communicated into an internal cavity of the component and can be discharged through one or more of the cooling holes to provide a boundary layer of film cooling air at the outer skin of the component. The film cooling air provides a barrier that protects the underlying substrate of the component from the hot combustion gases that are communicated along the core flow path.

SUMMARY

A component for a gas turbine engine according to an exemplary aspect of the present disclosure includes, among other things, a wall having an internal surface and an outer skin, a cooling hole having an inlet extending from the internal surface and merging into a metering section, and a diffusion section downstream of the metering section that extends to an outlet located at the outer skin. The diffusion section of the cooling hole includes a first side diffusion angle, a second side diffusion angle and a downstream diffusion angle at a downstream surface of the diffusion section, the downstream diffusion angle being less than the first side diffusion angle and the second side diffusion angle.

In a further non-limiting embodiment of the foregoing component, the wall is part of a vane.

In a further non-limiting embodiment of either of the foregoing components, the wall is part of a blade.

In a further non-limiting embodiment of any of the foregoing components, the wall is part of a blade outer air seal (BOAS).

In a further non-limiting embodiment of any of the foregoing components, the diffusion section includes a first side surface that diverges in a first axial direction from an axis of the metering section and a second side surface that diverges in a second axial direction from the axis.

In a further non-limiting embodiment of any of the foregoing components, the first side surface and the second side surface diverge at the first and second side diffusion angles relative to the axis.

In a further non-limiting embodiment of any of the foregoing components, the side diffusion angles are between 1° and 15° relative to the axis.

In a further non-limiting embodiment of any of the foregoing components, the downstream diffusion angle is 0° from an axis of the metering section.

In a further non-limiting embodiment of any of the foregoing components, the downstream diffusion angle is between 0° and 10°.

In a further non-limiting embodiment of any of the foregoing components, the first side diffusion angle is a different angle from the second side diffusion angle.

In a further non-limiting embodiment of any of the foregoing components, the downstream surface of the diffusion section is coaxial with a downstream surface of the metering section.

In a further non-limiting embodiment of any of the foregoing components, the diffusion section does not diffuse toward a downstream edge of the wall.

A component for a gas turbine engine according to an exemplary aspect of the present disclosure includes, among other things, a wall having an internal surface and an outer skin, a cooling hole having an inlet extending from the internal surface and merging into a metering section, and a diffusion section downstream of the metering section that extends to an outlet located at the outer skin. Each of the metering section and the diffusion section includes a downstream surface, and the downstream surface of the diffusion section is coaxial with the downstream surface of the metering section.

In a further non-limiting embodiment of the foregoing component, the downstream surface excludes a downstream diffusion angle.

In a further non-limiting embodiment of either of the foregoing components, the diffusion section includes a first side surface that diverges in a first axial direction from an axis of the metering section and a second side surface that diverges in a second axial direction from the axis.

In a further non-limiting embodiment of any of the foregoing components, the first side surface and the second side surface diverge at a side diffusion angle of between 1° and 15° from the axis.

In a further non-limiting embodiment of any of the foregoing components, the downstream surface of the diffusion section diffuses at a 0° angle relative to an axis of the metering section.

A method of forming a cooling hole in a component of a gas turbine engine according to another exemplary aspect of the present disclosure includes, among other things, the step of forming a cooling hole in a wall of the component including an inlet extending from an internal surface of the wall toward an outer skin of the wall. The inlet merges into a metering section and provides the cooling hole with a diffusion section downstream of the metering section, the diffusion section including a downstream surface that is coaxial with an axis of the metering section.

In a further non-limiting embodiment of the foregoing method, the step of providing the cooling hole with the diffusion section includes excluding a downstream diffusion angle in the diffusion section of the cooling hole.

In a further non-limiting embodiment of either of the foregoing methods, the step of providing the cooling hole with the diffusion section includes providing the diffusion section with a first side surface that extends in a first axial direction from the axis and a second side surface that extends in a second axial direction from the axis.

The various features and advantages of this disclosure will become apparent to those skilled in the art from the following detailed description. The drawings that accompany the detailed description can be briefly described as follows.

DETAILED DESCRIPTION

Figure 1:
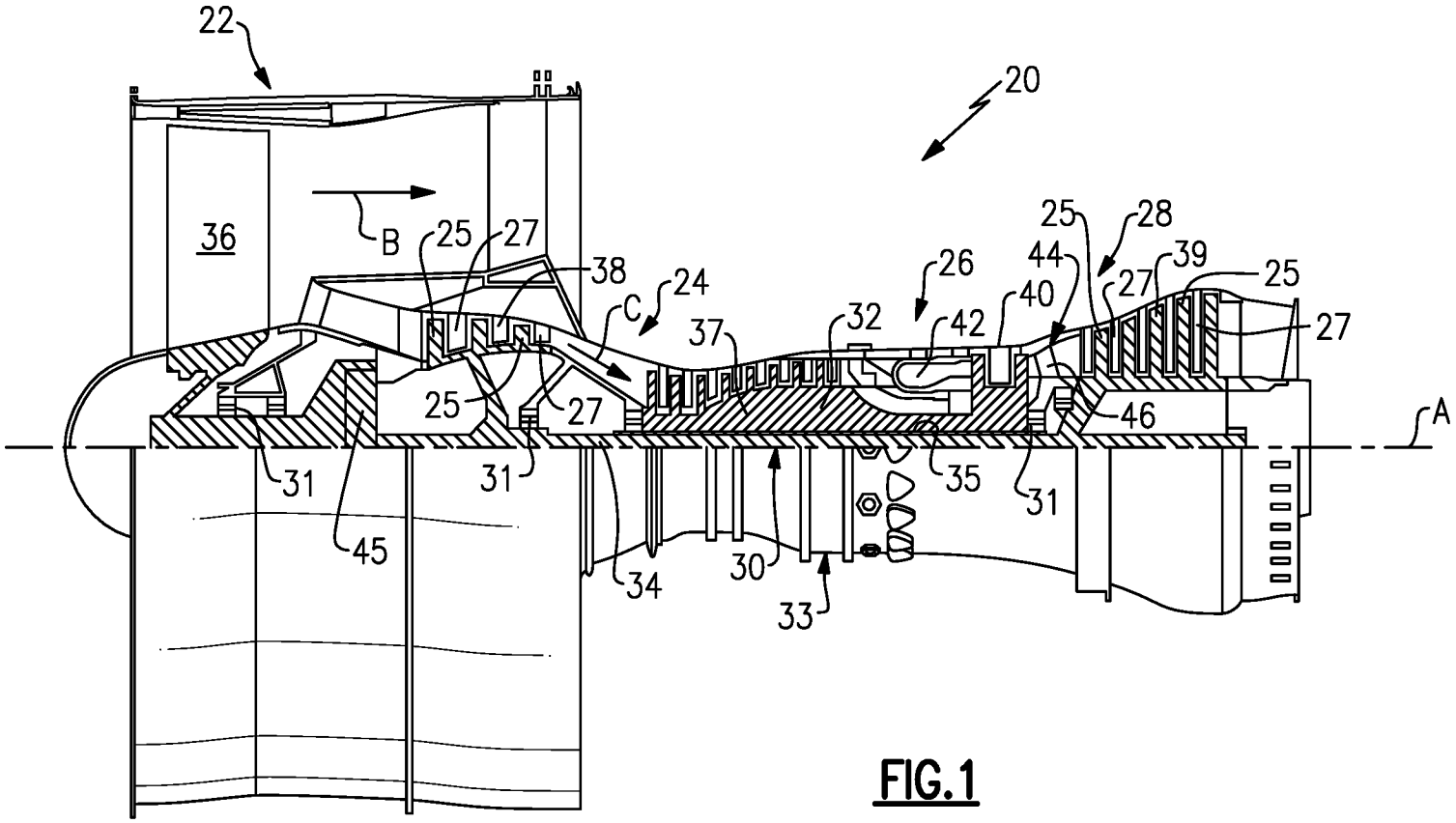
FIG. 1 illustrates a schematic, cross-sectional view of a gas turbine engine.

FIG. 1 schematically illustrates a gas turbine engine 20. The exemplary gas turbine engine 20 is a two-spool turbofan engine that generally incorporates a fan section 22, a compressor section 24, a combustor section 26 and a turbine section 28. Alternative engines might include an augmenter section (not shown) among other systems for features. The fan section 22 drives air along a bypass flow path B, while the compressor section 24 drives air along a core flow path C for compression and communication into the combustor section 26. The hot combustion gases generated in the combustor section 26 are expanded through the turbine section 28. Although depicted as a turbofan gas turbine engine in the disclosed non-limiting embodiment, it should be understood that the concepts described herein are not limited to turbofan engines and these teachings could extend to other types of engines, including but not limited to, three-spool engine architectures.

The gas turbine engine 20 generally includes a low speed spool 30 and a high speed spool 32 mounted for rotation about an engine centerline longitudinal axis A. The low speed spool 30 and the high speed spool 32 may be mounted relative to an engine static structure 33 via several bearing systems 31. It should be understood that other bearing systems 31 may alternatively or additionally be provided.

The low speed spool 30 generally includes an inner shaft 34 that interconnects a fan 36, a low pressure compressor 38 and a low pressure turbine 39. The inner shaft 34 can be connected to the fan 36 through a geared architecture 45 to drive the fan 36 at a lower speed than the low speed spool 30. The high speed spool 32 includes an outer shaft 35 that interconnects a high pressure compressor 37 and a high pressure turbine 40. In this embodiment, the inner shaft 34 and the outer shaft 35 are supported at various axial locations by bearing systems 31 positioned within the engine static structure 33.

A combustor 42 is arranged between the high pressure compressor 37 and the high pressure turbine 40. A mid-turbine frame 44 may be arranged generally between the high pressure turbine 40 and the low pressure turbine 39. The mid-turbine frame 44 can support one or more bearing systems 31 of the turbine section 28. The mid-turbine frame 44 may include one or more airfoils 46 that extend within the core flow path C.

The inner shaft 34 and the outer shaft 35 are concentric and rotate via the bearing systems 31 about the engine centerline longitudinal axis A, which is co-linear with their longitudinal axes. The core airflow is compressed by the low pressure compressor 38 and the high pressure compressor 37, is mixed with fuel and burned in the combustor 42, and is then expanded over the high pressure turbine 40 and the low pressure turbine 39. The high pressure turbine 40 and the low pressure turbine 39 rotationally drive the respective high speed spool 32 and the low speed spool 30 in response to the expansion.

The pressure ratio of the low pressure turbine 39 can be pressure measured prior to the inlet of the low pressure turbine 39 as related to the pressure at the outlet of the low pressure turbine 39 and prior to an exhaust nozzle of the gas turbine engine 20. In one non-limiting embodiment, the bypass ratio of the gas turbine engine 20 is greater than about ten (10:1), the fan diameter is significantly larger than that of the low pressure compressor 38, and the low pressure turbine 39 has a pressure ratio that is greater than about five (5:1). It should be understood, however, that the above parameters are only exemplary of one embodiment of a geared architecture engine and that the present disclosure is applicable to other gas turbine engines, including direct drive turbofans.

In this embodiment of the exemplary gas turbine engine 20, a significant amount of thrust is provided by the bypass flow path B due to the high bypass ratio. The fan section 22 of the gas turbine engine 20 is designed for a particular flight condition—typically cruise at about 0.8 Mach and about 35,000 feet. This flight condition, with the gas turbine engine 20 at its best fuel consumption, is also known as bucket cruise Thrust Specific Fuel Consumption (TSFC). TSFC is an industry standard parameter of fuel consumption per unit of thrust.

Fan Pressure Ratio is the pressure ratio across a blade of the fan section 22 without the use of a Fan Exit Guide Vane system. The low Fan Pressure Ratio according to one non-limiting embodiment of the example gas turbine engine 20 is less than 1.45. Low Corrected Fan Tip Speed is the actual fan tip speed divided by an industry standard temperature correction of $[(\text{Tram}^\circ\ \text{R})/(518.7^\circ\ \text{R})]^{0.5}$, where T represents the ambient temperature in degrees Rankine. The Low Corrected Fan Tip Speed according to one non-limiting embodiment of the example gas turbine engine 20 is less than about 1150 fps (351 m/s).

Each of the compressor section 24 and the turbine section 28 may include alternating rows of rotor assemblies and vane assemblies (shown schematically) that carry airfoils that extend into the core flow path C. For example, the rotor assemblies can carry a plurality of rotating blades 25, while each vane assembly can carry a plurality of vanes 27 that extend into the core flow path C. The blades 25 create or extract energy (in the form of pressure) from the core airflow that is communicated through the gas turbine engine 20 along the core flow path C. The vanes 27 direct the core airflow to the blades 25 to either add or extract energy.

Various components of a gas turbine engine 20, including but not limited to the airfoil and platform portions of the blades 25 and the vanes 27 of the compressor section 24 and the turbine section 28, may be subjected to repetitive thermal cycling under widely ranging temperatures and pressures.

The hardware of the turbine section 28 is particularly subjected to relatively extreme operating conditions. Therefore, some components may require dedicated cooling techniques to cool the parts during engine operation. This disclosure relates to cooling holes that may be incorporated into the components of the gas turbine engine as part of a cooling arrangement for achieving such cooling.

Figure 2A:
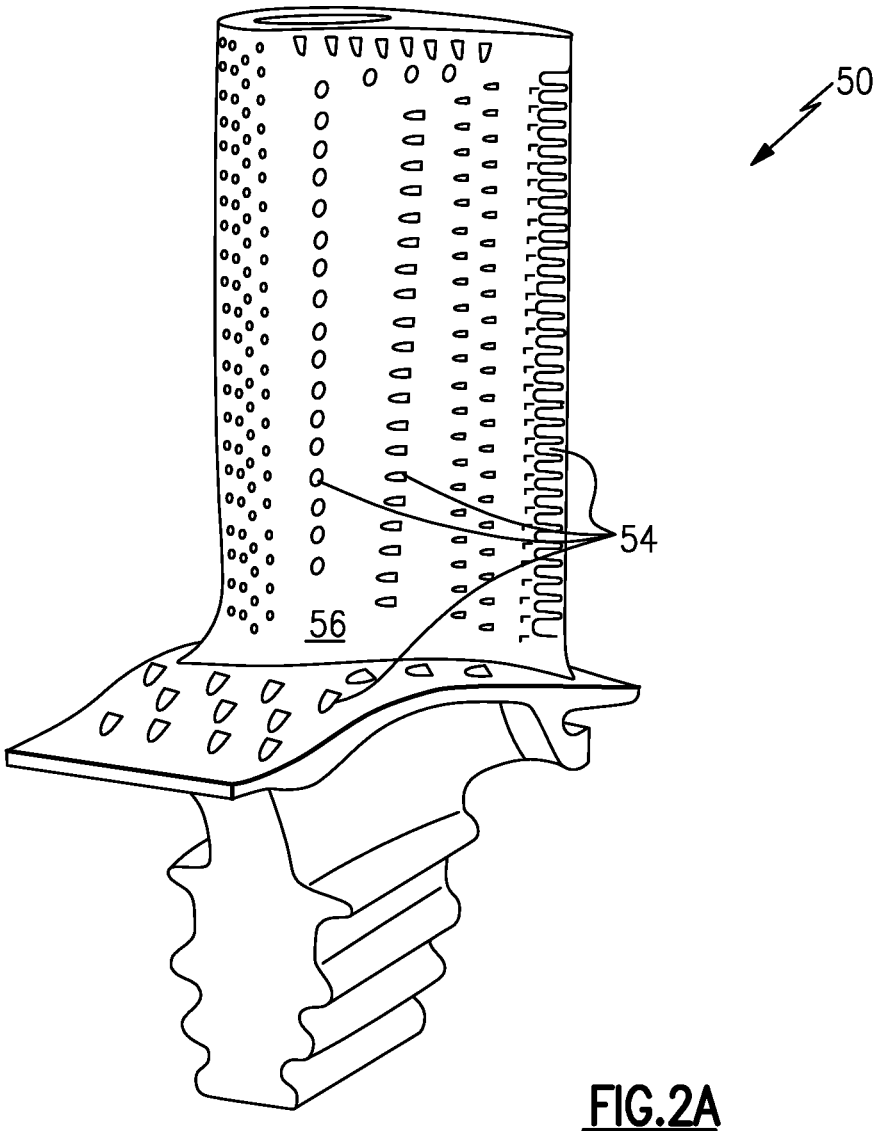
FIG. 2A illustrates a component that may incorporate one or more cooling holes according to this disclosure.
Figure 2B:
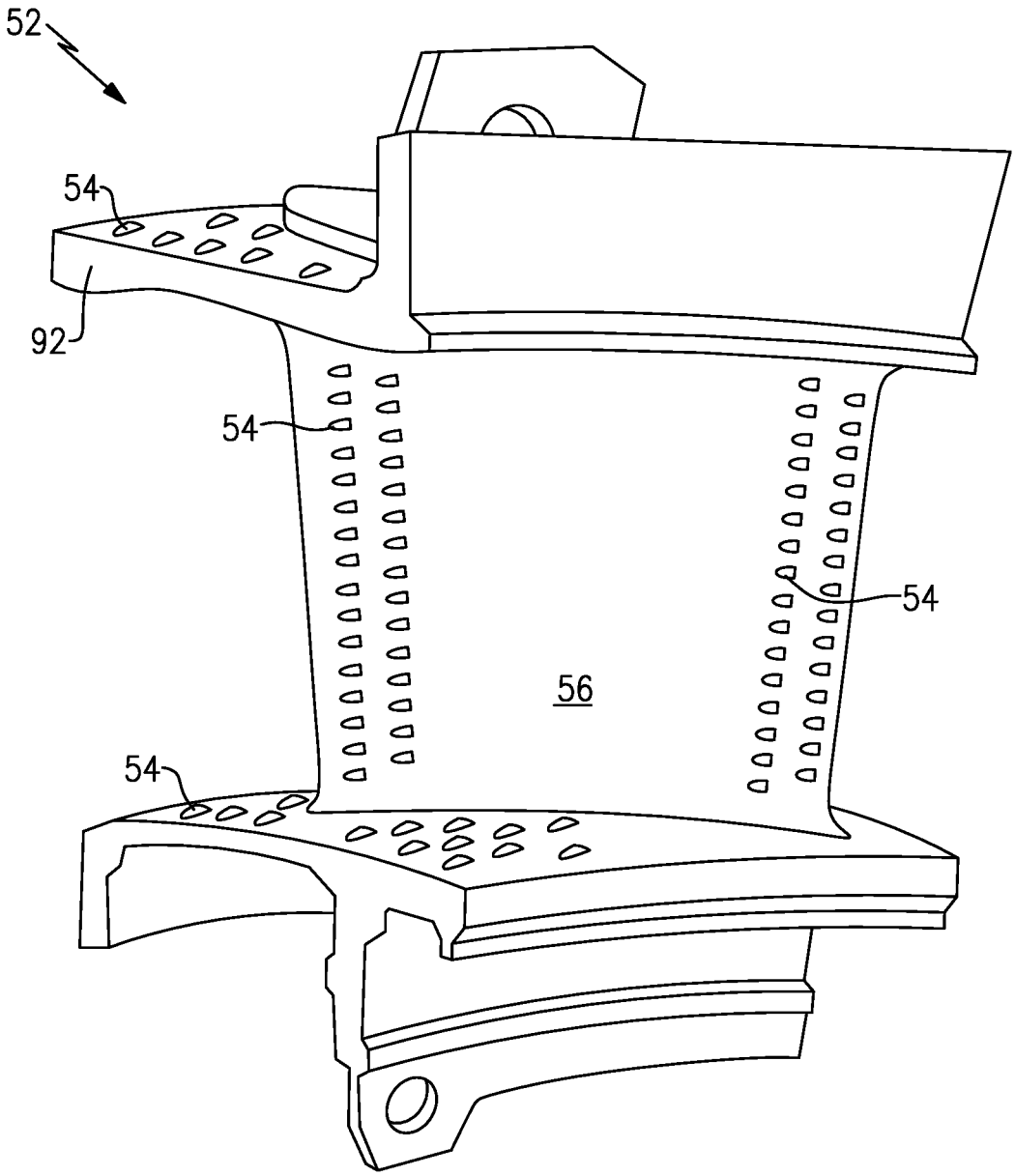
FIG. 2B illustrates a second embodiment.

FIG. 2A illustrates a first embodiment of a component 50 that can be incorporated into a gas turbine engine, such as the gas turbine engine 20 of FIG. 1. The component 50 is illustrated as a turbine blade. FIG. 2B illustrates a second embodiment of a component 52 that can be incorporated into the gas turbine engine 20. In the FIG. 2B embodiment, the component 52 is a turbine vane. Although described and depicted herein as turbine components, the features of this disclosure could be incorporated into any component that requires dedicated cooling, including but not limited to any component that is positioned within the core flow path C (FIG. 1) of the gas turbine engine 20. For example, blade outer air seals (BOAS) may also benefit from the cooling holes described in this disclosure.

As shown in FIGS. 2A and 2B, the components 50, 52 include one or more cooling holes 54 that are formed at an outer skin 56 of walls of the components 50, 52. Any of these cooling holes 54 may benefit from reducing or even omitting a downstream diffusion angle in a diffusion section of the cooling hole 54. Exemplary characteristics of such a cooling hole will be discussed below. The exemplary cooling holes 54 provide adequate film coverage while allowing for the centerline of the cooling hole to be moved closer to an edge 92 (see, for example, FIGS. 2B and 5) of the component, thereby more effectively and efficiently cooling the edge of the component through convection and film cooling.

Figure 3:
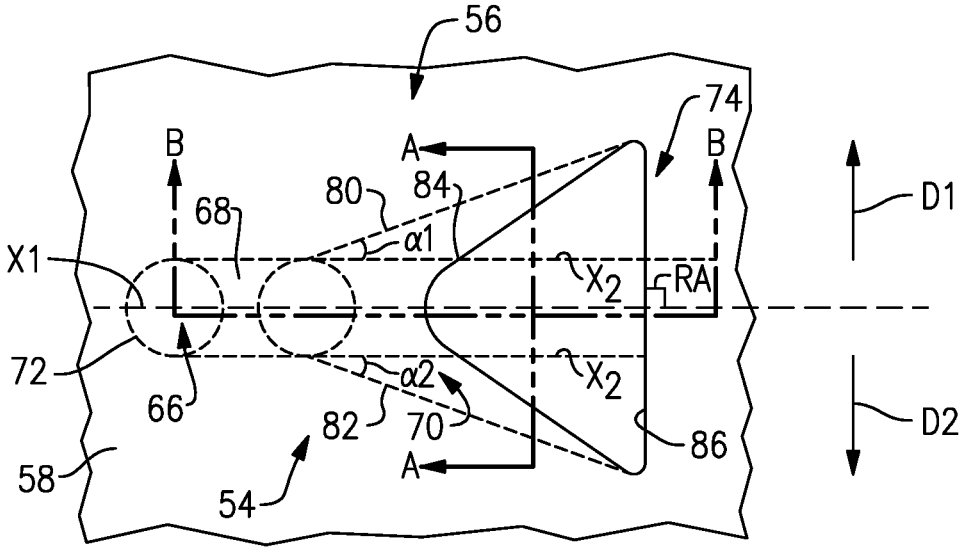
FIG. 3 illustrates an exemplary cooling hole that can be incorporated into a component of a gas turbine engine.

FIG. 3 illustrates one exemplary cooling hole 54 that can be formed within a component, such as the component 50 (FIG. 2A), the component 52 (FIG. 2B), or any other gas turbine engine component. The cooling hole 54 may be disposed within a wall 58. The wall 58 extends between an internal surface 64 (see FIG. 5) that faces into a cavity 66 of the component. For example, the cavity 66 may be a cooling cavity that receives a cooling air to cool the wall 58. The cooling air may flow from the cavity 66 into the cooling hole 54. The wall 58 also includes an outer skin 56 on an another side (such as an opposite side) of the internal surface 64.

The cooling hole 54 includes an inlet 72, a metering section 68, a diffusion section 70 and an outlet 74. The inlet 72 of the cooling hole 54 may extend from the internal surface 64 and merge into the metering section 68. The metering section 68 extends into an enlarged diffusion section 70, which extends to the outlet 74 at the outer skin 56. The design characteristics of the cooling hole 54 are discussed in greater detail below, and this disclosure could extend to any number of sizes and orientations of the several sections of the cooling hole 54.

The metering section 68 is adjacent to and downstream from the inlet 72 and controls (meters) the flow of cooling air through the cooling hole 54. In exemplary embodiments, the metering section 68 has a substantially constant flow area from the inlet 72 to the diffusion section 70. The metering section 68 can have circular, oblique (oval or elliptic), racetrack (oval with two parallel sides having straight portions), crescent shaped, or other shaped axial cross-sections. The metering section 68 shown in FIG. 3 and FIG. 4 has a circular cross-section. In other exemplary embodiments, the metering section 68 is inclined with respect to the internal surface 64 as best illustrated by FIG. 5 (i.e., the metering section 68 may be non-perpendicular relative to the internal surface 64).

The diffusion section 70 is adjacent to and downstream from the metering section 68. Cooling air is diffused within the diffusion section 70. Cooling air may enter the cooling hole 54 through the inlet 72 and may be communicated through the metering section 68 and the diffusion section 70 before exiting the cooling hole 54 at the outlet 74 to provide a boundary layer of film cooling air along the outer skin 56 of the wall 58.

The outlet 74 of the cooling hole 54 may include a leading edge 84 and a trailing edge 86. In one embodiment, the trailing edge 86 of the outlet 74 of the diffusion section 70 is generally linear, and defines the downstream most end across the entire width of the cooling hole 54. Stated another way, for a symmetrical embodiment such as shown in FIG. 3, the trailing edge 86 defines an angle RA relative to a centerline axis X1. In one embodiment, the angle RA is a square or right angle. Of course, symmetrical or non-symmetrical cooling holes with non-square trailing edges could also benefit from the teachings of this disclosure.

Figure 4:
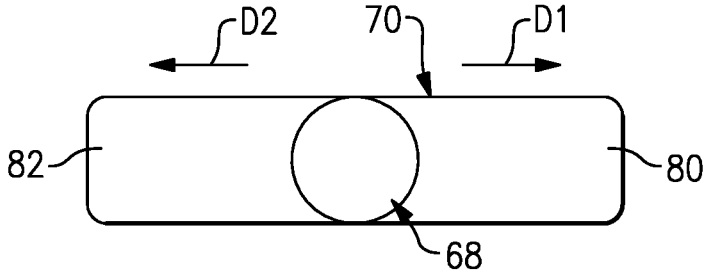
FIG. 4 illustrates another view of an exemplary cooling hole through section A-A of FIG. 3.
Figure 5:
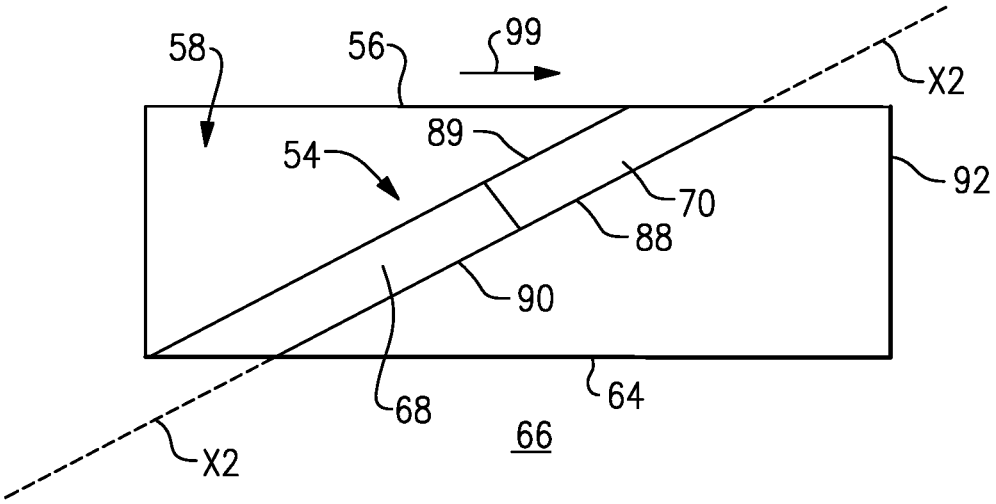
FIG. 5 illustrates yet another view of an exemplary cooling hole through section B-B of FIG. 3.

Referring to FIGS. 3 and 4, the diffusion section 70 of the cooling hole 54 can include a first side surface 80 that diverges laterally from the metering section 68 in a first axial direction D1 and a second side surface 82 that diverges laterally from the metering section 68 in a second axial direction D2. In one embodiment, the first side surface 80 and the second side surface 82 diverge at side diffusion angles $\alpha 1$ and $\alpha 2$ relative to an axis X2 of the metering section 68 of the cooling hole 54. The side diffusion angles $\alpha 1$ and $\alpha 2$ are each between 1° and 15° relative to the axis X2 of the metering section 68, in one embodiment. In another embodiment, the side diffusion angles $\alpha 1$ and $\alpha 2$ are not equal (i.e., the diffusion angle $\alpha 1$ is a different angle than the diffusion angle $\alpha 2$).

FIG. 5 illustrates additional features of the exemplary cooling hole 54. The diffusion section 70 of the cooling hole 54 includes a downstream surface 88. In this embodiment, the downstream surface 88 of the diffusion section 70 is coaxial with a downstream surface 90 of the metering section 68. Put another way, the downstream surface 88 of the diffusion section 70 excludes any downstream diffusion angle relative to the axis X2 of the metering section 68 (i.e., the downstream diffusion angle is 0° relative to the axis X2 and does not diffuse toward an edge 92 of the wall 58). In another embodiment, the downstream surface 88 of the diffusion section 70 is not angled in the direction of a gas path 99 that flows across the outer skin 56 along the core flow path C. In yet another embodiment, an upstream surface 89 of the diffusion section 70 is also coaxial with the metering section 68. In other words, the diffusion section 70 is only diffused on two sides. However, the diffusion section 70 could alternatively include a diffusion angle that is less than the side diffusion angles $\alpha 1$ and $\alpha 2$. In one embodiment, the downstream diffusion angle of the diffusion section 70 is between 0° and 10°.

In one non-limiting embodiment, a cooling hole 54 having the features described in FIGS. 3, 4 and 5 may be described as a 10-0-10 axial-shaped cooling hole. The 10-0-10 axial-shaped cooling hole includes side diffusion angles $\alpha 1$ and $\alpha 2$ of 10° and a downstream diffusion angle of 0°. The centerline axis A1 of the cooling hole 54 of the exemplary embodiments may extend relatively close to the edge 92 of the wall 58 as compared to prior art cooling holes since the downstream surface 88 does not diffuse toward the edge 92, thus providing better convective cooling. In addition, by reducing or eliminating the downstream diffusion angle, the cooling hole 54 can be plunged deeper without breaking the edge 92 of the wall 58, thereby providing larger footprints that may increase film cooling.

Figure 6:
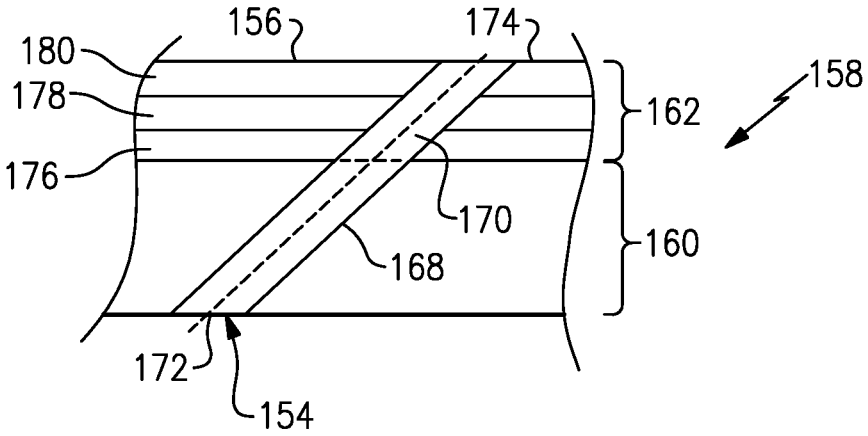
FIG. 6 shows another embodiment.

Another embodiment of a cooling hole 154 is illustrated with respect to FIG. 6. The cooling hole 154 may be disposed within a wall 158 that is formed from a substrate 160 and a coating layer 162 that is disposed on top of the substrate 160. In one embodiment, the substrate 160 is a metallic substrate and the coating layer 162 includes either a ceramic or a metallic coating.

The coating layer 162 of the wall 158 may include sub-layers, such as a bonding layer 176, an inner coating layer 178 and an outer coating layer 180. In one embodiment, the outer coating layer 180 includes a thermal bearing coating that helps the component survive the extremely hot temperatures it may face during gas turbine engine operation. The inner coating layer 178 may also be a thermal barrier coating, or a corrosion resistant coating, or any other suitable coating. Of course, there may be fewer or additional layers, such as a third thermal barrier coating outward of the outer coating layer 180. Any number of other combinations of coatings would come within the scope of this disclosure.

In this embodiment, the entire diffusion section 170 of the cooling hole 154 is formed within the coating layer 162, and the metering section 168 is formed entirely within the substrate 160. Other embodiments are also contemplated in which only a portion of the diffusion section 170 is disposed in the coating layer 162.

It should be understood that although the disclosed embodiments show the outer skin at an outer surface of a component, it is possible that the wall could be an interior wall, and thus the outer skin would not necessarily be at an outer surface of a component.

Although the different non-limiting embodiments are illustrated as having specific components, the embodiments of this disclosure are not limited to those particular combinations. It is possible to use some of the components or features from any of the non-limiting embodiments in combination with features or components from any of the other non-limiting embodiments.

It should be understood that like reference numerals identify corresponding or similar elements throughout the several drawings. It should also be understood that although a particular component arrangement is disclosed and illustrated in these exemplary embodiments, other arrangements could also benefit from the teachings of this disclosure.

The foregoing description shall be interpreted as illustrative and not in any limiting sense. A worker of ordinary skill in the art would understand that certain modifications could come within the scope of this disclosure. For these reasons, the following claims should be studied to determine the true scope and content of this disclosure.

What is claimed is:

1. A component for a gas turbine engine, comprising:

a wall having an internal surface and an outer skin; and a cooling hole having an inlet extending from said internal surface and merging into a metering section, and a diffusion section downstream of said metering section that extends to an outlet located at said outer skin, wherein each of said metering section and said diffusion section includes a downstream surface, said downstream surface of said diffusion section is coaxial with said downstream surface of said metering section, said diffusion section includes a diffusion section inlet and a diffusion section outlet downstream of said diffusion section inlet, said diffusion section outlet includes a linear edge that is defined where said downstream surface meets said outer skin, and said diffusion section includes a first side surface and a second side surface, and each of said first side surface and said second side surface diverge from an axis of said metering section at a side diffusion angle of about 10°.

2. The component as recited in claim 1, wherein said component is a turbine blade.

3. The component as recited in claim 1, wherein said component is a turbine vane.

4. The component as recited in claim 1, wherein said diffusion section includes said outlet having a leading edge and said trailing edge.

5. The component as recited in claim 1, wherein said internal surface faces a cavity.

6. A method of forming a cooling hole in a component of a gas turbine engine, the method comprising:

forming a cooling hole in a wall of said component including an inlet extending from an internal surface of said wall toward an outer skin of said wall, said inlet merging into a metering section; and providing said cooling hole with a diffusion section downstream of said metering section, said diffusion section including a downstream surface that is coaxial with an axis of said metering section, a linear trailing edge that is defined where said downstream surface meets said outer skin, a first side surface and a second side surface, and each of said first side surface and said second side surface diverge from an axis of said metering section at a side diffusion angle of about 10°.

7. The method as recited in claim 6, wherein said component is a turbine vane.

8. The method as recited in claim 6, wherein said component is a turbine blade.

9. A gas turbine engine, comprising:

a turbine section;

a component within the turbine section, said component including a wall having an internal surface and an outer skin;

a cooling hole having an inlet extending from said internal surface and merging into a metering section, and a diffusion section downstream of said metering section that extends to an outlet located at said outer skin; and wherein each of said metering section and said diffusion section includes a downstream surface, said downstream surface of said diffusion section is coaxial with said downstream surface of said metering section, said diffusion section includes a diffusion section inlet and a diffusion section outlet downstream of said diffusion section inlet, said diffusion section outlet includes a trailing edge that is generally linear, defines the downstream most end of said cooling hole, and is defined where said downstream surface meets said outer skin, wherein said diffusion section includes a first side surface and a second side surface, and each of said first side surface and said second side surface diverge from an axis of said metering section at a side diffusion angle of about 10°.

10. The gas turbine engine as recited in claim 9, wherein said component is a turbine blade.

11. The gas turbine engine as recited in claim 9, wherein said component is a turbine vane.

12. The gas turbine engine as recited in claim 9, wherein said diffusion section includes an outlet having a leading edge and said trailing edge.

13. The component as recited in claim 1, wherein said inlet and said metering section extend along said axis from said internal surface to said diffusion section.

14. The component as recited in claim 13, wherein said metering section has a circular cross section.

15. The component as recited in claim 13, wherein said metering section has an oblique cross section.

16. The component as recited in claim 13, wherein said metering section has a racetrack cross section.

17. The component as recited in claim 13, wherein said metering section has a crescent shaped cross section.

18. The component as recited in claim 1, wherein said side diffusion angle is 10°.

* * * * *